US005513806A

United States Patent [19]

Falcon-Steward

[11] Patent Number: 5,513,806

[45] Date of Patent: May 7, 1996

[54] AUTOGENOUS COMMINUTION IN A PLANETARY MILL

[75] Inventor: Hugh R. Falcon-Steward, St. Austell, United Kingdom

[73] Assignee: ECC International Limited, United Kingdom

[21] Appl. No.: 268,276

[22] Filed: Jun. 29, 1994

Related U.S. Application Data

[62] Division of Ser. No. 910,211, Jul. 9, 1992.

[30] Foreign Application Priority Data

Jul. 9, 1991 [GB] United Kingdom ..... 9114792

[51] Int. Cl.[6] ..... B02C 17/08

[52] U.S. Cl. ..... 241/21; 241/24; 241/137

[58] Field of Search ..... 241/20, 21, 16, 241/24, 137, 175, 184

[56] References Cited

U.S. PATENT DOCUMENTS 5,029,760 7/1991 Gamblin .

FOREIGN PATENT DOCUMENTS 0221377 5/1987 European Pat. Off. .
436534 10/1935 United Kingdom .
527522 10/1940 United Kingdom .
746059 3/1956 United Kingdom .
746716 3/1956 United Kingdom .
1217155 12/1970 United Kingdom .
1387100 3/1975 United Kingdom .
1506977 4/1978 United Kingdom .
1586851 3/1981 United Kingdom .
2070986 9/1981 United Kingdom .
2179873 3/1987 United Kingdom .
2200103 7/1988 United Kingdom .

OTHER PUBLICATIONS

Qian–Qiu Zhao et al., "The Mechanism and Grinding Limit of Planetary Ball Milling", Kona, No. 7 (1989) pp. 29–36.

*Primary Examiner*—Douglas D. Watts
*Attorney, Agent, or Firm*—Klauber & Jackson

[57] ABSTRACT

The present invention relates to apparatus for comminuting a material. The apparatus comprises a support (4) which is rotatable about a primary axis, and a grinding vessel (17), defining a grinding chamber, which is mounted on the support (4) for rotation about a secondary axis which is substantially parallel to the primary axis. The grinding vessel (17) is provided with an inlet (34) for a feed suspension of particulate solid material and an outlet (36) for a suspension for a fine product. In the first embodiment the grinding vessel (17) communicates with the outlet (36 ) through a screen (35 ). In the second embodiment, the inlet (34) comprises means for regulating the flow rate of the feed suspension. The invention also relates to a process for comminuting a material in a planetary mill, in which process the material is either ground autogenously or is ground in the presence of a grinding medium consising of particles not larger than 1mm.

10 Claims, 6 Drawing Sheets

1
2
3
4
5
6
7
8
9
10
11
12
13
14
15
16
17
18
19
20
21
22
23
24
25
26
27
28
29
30
31
32A
32B
33
34
35
36
37
d

FIG. 3.
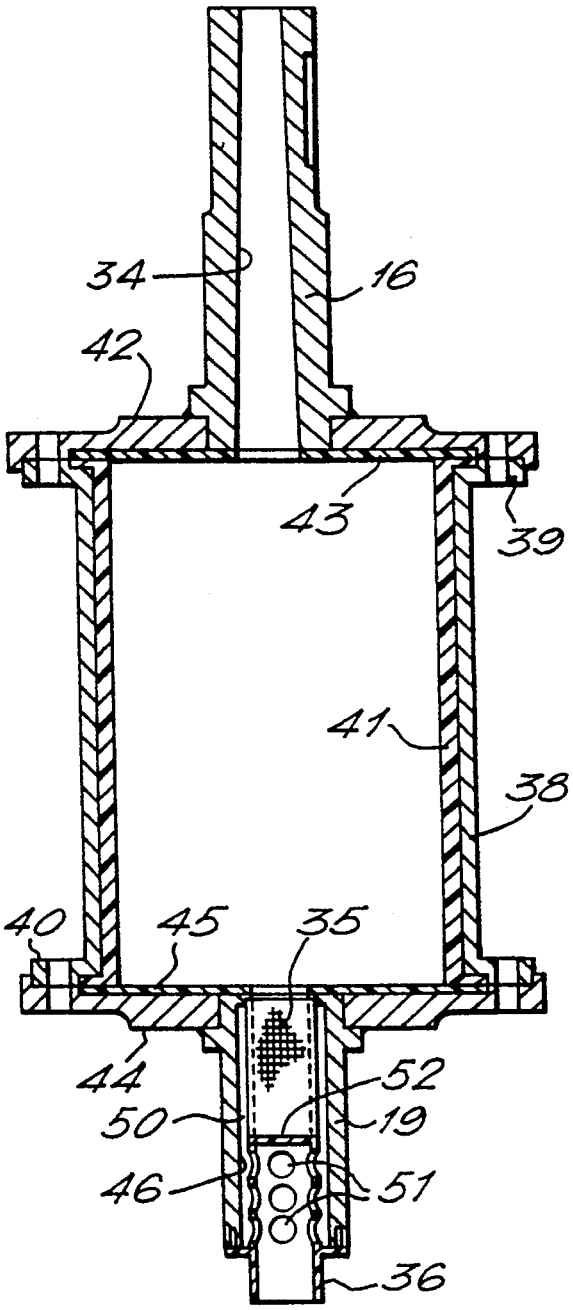
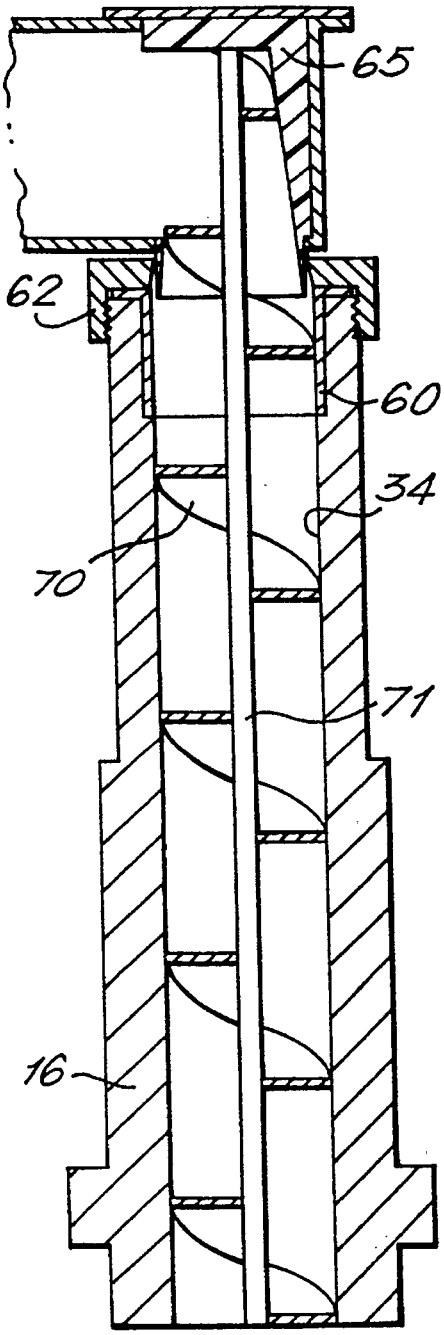
FIG. 7.

FIG. 8A
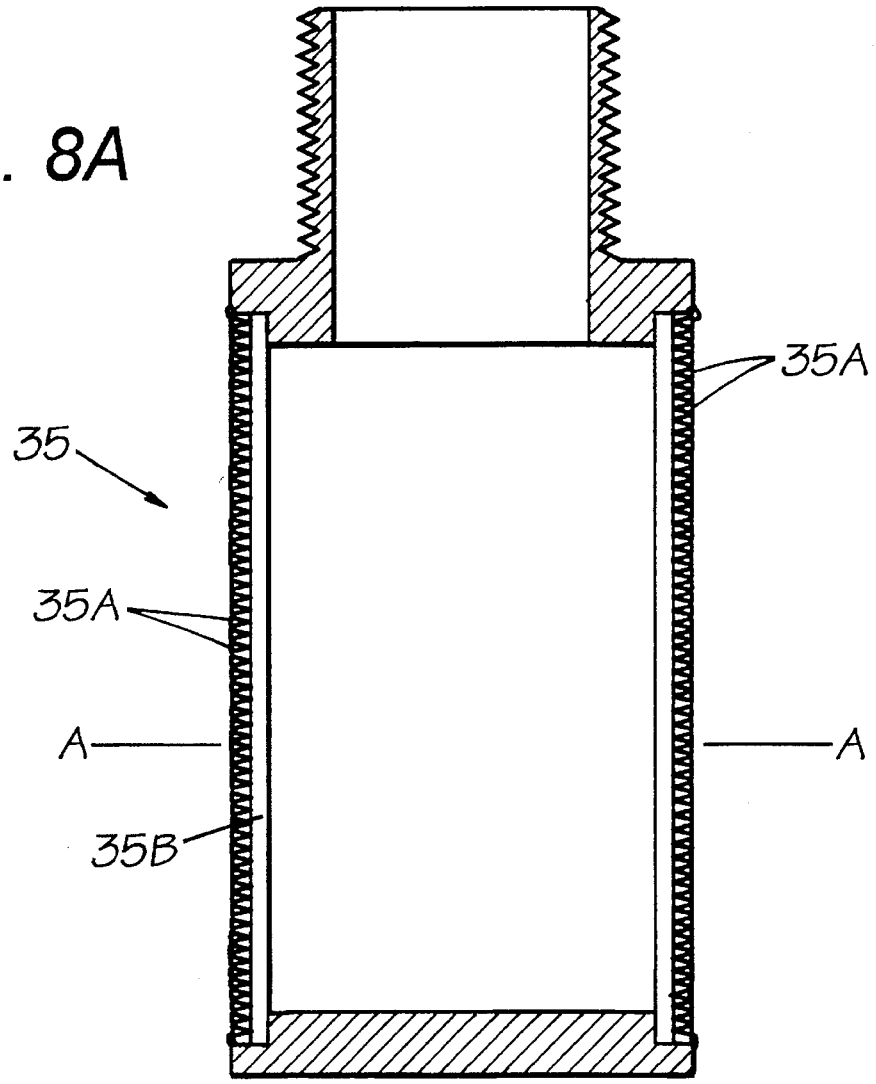
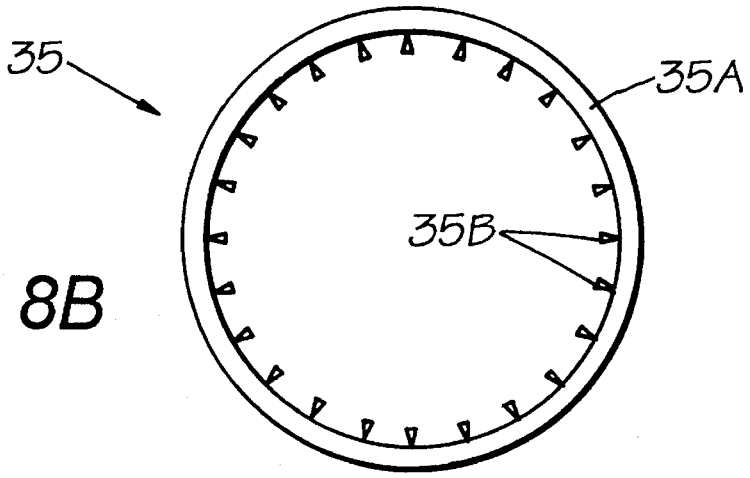
FIG. 8B

AUTOGENOUS COMMINUTION IN A PLANETARY MILL

This is a Division of application Ser. No. 7/910,211, filed Jul. 9, 1992.

The invention concerns the use of a known grinding system, that of the planetary mill, for wet grinding particulate solid materials and particularly, although not exclusively for ultra fine grinding of particulate solid materials. By "ultra-fine grinding" we mean grinding to produce a ground material containing a substantial proportion by weight, for example at least 40% by weight, of particles having an equivalent spherical diameter smaller than 2 microns.

One of the most commonly used types of grinding mill is the tumbling mill which generally comprises a cylindrical or frusto-conical drum rotating about a horizontal longitudinal axis. The mill contains a grinding medium such as pebbles or steel balls which reduce the size of the particles of the feed material primarily by impact. The speed of rotation of such a mill is limited because, at a particular speed, known as the critical speed, the centrifugal acceleration due to the rotation of the mill becomes equal to the acceleration due to gravity, so that at rotational speeds above this critical level the contents of the mill are carried round as an annular mass against the walls of the mill instead of undergoing a tumbling action, and impacts between grinding elements and particles in the feed material virtually cease.

It has been found that with tumbling mill grinding, if it is desired to produce a ground product containing a high proportion of ultra-fine particles, a grinding medium of small particle size should be used. However, when the particles of the grinding medium are small, they are also light in weight, and can therefore attain only a relatively low level of momentum. Since grinding in a tumbling mill takes place primarily by impact, the rate of ultra-fine grinding is inevitably very slow.

It is also known to use a stirred media mill of the type described in British Patent Specification No. 1469028 for ultra-fine grinding of materials, but, by this grinding method also, considerable time is required to produce an ultra-fine product.

British Patent Specification No. 1569969 describes a process in which a material in the form of chippings of up to about 12 mm in size is comminuted by autogenous grinding in a stirred media mill but it has been found to be impossible to achieve a product which has substantially more than about 40% by weight of particles having an equivalent spherical diameter smaller than 2 microns by this method. It is generally necessary to subject the product of the autogenous grinding operating to a second grinding stage by stirring with a grinding medium of small particle size in order to achieve an ultra-fine product.

According to a first aspect of the present invention, there is provided a continuous process for wet grinding a material in a planetary mill, in which process feed material is comminuted in the presence of a grinding medium consisting of particles not larger than 1 mm.

Preferably, the feed material is comminuted in the presence of a grinding medium consisting of particles not smaller than 0.5 mm.

According to a second aspect of the present invention, there is provided a continuous process for wet grinding a material in a planetary mill, in which process the material is comminuted autogenously. The material to be ground may be a particulate solid material and is preferably introduced into the planetary mill in suspension in a liquid. Preferably, the liquid is water.

Preferably, the comminuted product comprises at least 40% by weight of particles having an equivalent spherical diameter smaller than 2 microns.

The maximum centrifugal acceleration of the particles in the planetary mill is preferably not less than three times and is more preferably not less than five times the acceleration due to gravity.

In a preferred embodiment, the planetary mill comprises a support which rotates about a primary axis and which carries a grinding chamber which rotates about a secondary axis, relatively to the support, in the direction opposite to the direction of rotation of the support. Preferably, the grinding chamber rotates about the secondary axis at a speed greater than the speed of rotation of the support at the primary axis.

According to a third aspect of the present invention there is provided apparatus for wet grinding a material, which apparatus comprises a support which is rotatable about a primary axis, and a grinding vessel, defining a grinding chamber, which is mounted on the support for rotation about a secondary axis which is substantially parallel to the primary axis, the grinding vessel being provided with an inlet for a feed suspension of a particulate solid material and an outlet for a suspension of a fine product, the grinding chamber communicating with the outlet through a screen. Preferably, the aperture size of the screen is not greater than 0.3 mm.

In a preferred embodiment, the screen is cylindrical with one end closed. The other end of the screen may be open to the grinding chamber or alternatively may be open to the outlet. The screen is preferably formed from wedge-shaped wire and may comprise a substantially helical element, the spacing between the turns of the helical element preferably being not greater than 0.3 mm. To construct the screen, the helical element may be fixed over a cage of longitudinally disposed rods preferably by welding.

In a preferred embodiment, the inlet comprises means for positively conveying the feed suspension. Preferably, the inlet comprises an inlet duct in which the conveying means is situated. In a preferred embodiment, the conveying means is a helical member rotatable with the grinding vessel to convey the feed suspension through the inlet duct. The helical member may comprise a single or a double helix. Preferably, an intake end of the inlet duct is provided with a tank rotatable with the support. A scoop may be provided at the intake end of the inlet duct.

For a better understanding of the present invention, reference is now made to the accompanying examples:

EXAMPLE 1

A sample of a marble powder which had been ground so that substantially all of the particles were smaller than 53 microns was mixed with sufficient water to form a suspension containing 75% by weight of dry marble powder, there being dissolved in the water 0.7% by weight, based on the weight of the dry marble powder, of a sodium polyacrylate dispersing agent. 115 ml of this suspension was charged to each grinding chamber of a laboratory batch type planetary mill together with 135 ml (359 g) of a grinding medium which consisted of Ottawa sand which passed through a No. 16 mesh British Standard sieve (nominal aperture 1.0 mm) but was retained on a No. 30 mesh British Standard sieve (nominal aperture 0.5 mm). The volume of each grinding chamber was 500 ml and the percentage of the volume of each grinding chamber occupied by the charge was therefore 50%, and the grinding medium accounted for 54% of the volume of the charge. The mill was rotated at a gyratory speed of 278 rpm and the grinding chambers rotated about their own axes, counter to the direction of the gyratory motion, at a speed of 556 rpm. This arrangement gives a maximum centrifugal acceleration of 17.3×gravitational acceleration. Grinding was continued for 30 minutes which was the time which has been found by experience to be necessary to produce a product having a particle size distribution such that about 90% by weight consisted of particles having an equivalent spherical diameter smaller then 2 microns. At the completion of this time the particle size distribution of the ground product was such that 0.06% by weight consisted of particles having an equivalent spherical diameter larger than 10 microns, 90% by weight consisted of particles having an equivalent spherical diameter smaller than 2 microns and 62% by weight consisted of particles having an equivalent spherical diameter smaller than 1 micron. 164 g of this product was produced in 30 minutes using 359 g of sand of specific gravity 2.65 so the rate of production was 2.42 tonnes/hours/$m^3$ of sand.

By comparison a sample of the same marble powder was ground to the same degree of fineness using a stirred sand mill of the type described in British Patent Specification No. 1469028 using the same grade of Ottawa sand as the grinding medium. In this case the rate of production of the fine product was 1.25 tonnes/hours/$m^3$ of sand.

EXAMPLE 2

Further samples of the suspension containing 75% by weight of dry marble powder, prepared as described in Example 1 above, were ground in the planetary mill using as the grinding medium four different grades of alumina granules of specific gravity 3.4. Each grinding chamber was charged with 115 ml of the suspension and 135 ml (459 g) of the grinding medium. The percentage of the volume of each grinding chamber occupied by the charge was therefore 50% and the grinding medium accounted for 54% of the volume of the charge. In each case grinding was continued for 30 minutes with the speeds of rotation the same as those given in Example 1. In each case the particle size distribution of the product was measured and the results are set forth in Table I below:

TABLE 1

| Grinding medium size (mm) | % by weight of the product smaller than 2 microns |
|---|---|
| −4.7 + 3.3 | 81.5 |
| −3.3 + 2.4 | 83.5 |
| −2.0 + 1.4 | 88.9 |
| −1.0 + 0.8 | 97.4 |

It can seen that the grinding medium consisting of particles smaller than 1 mm produced a finer product in a given time than the coarser grinding media.

EXAMPLE 3

Further samples of the suspension containing 75% by weight of dry marble powder, prepared as described in Example 1 above, were ground in the planetary mill using as the grinding medium Ottawa sand which passed through a No. 16 mesh British Standard sieve but was retained on a No. 30 mesh British Standard sieve (1.0 mm −0.5 mm). Each grinding chamber was charged with 115 ml of the suspension and 135 ml (359 g) of the grinding medium, so that the percentage of the volume of each grinding chamber occupied by the charge was 50%, and the grinding medium accounted for 54% of the volume of the charge. The mill was rotated at a gyratory speed of 278 rpm and the grinding chambers revolved about their own axes in the opposite direction at a speed 556 rpm. As grinding proceeded samples of the suspension were withdrawn and the percentages by weight of particles having equivalent spherical diameters greater than 10 microns and smaller than 2 microns, respectively, were determined. A graph was plotted of percentage by weight of particles greater than 10 microns against percentage by weight of particles smaller than 2 microns.

The experiment was repeated using further samples of the same marble suspension, but in this case the samples were ground using a stirred sand mill of the type described in British Patent Specification No. 1469028. Again a graph was plotted of percentage by weight of particles greater than 10 microns against percentage by weight of particles smaller than 2 microns.

From the graphs, values of the percentage by weight of particles greater than 10 microns were obtained corresponding to a series of given values of percentage by weight of particles smaller than 2 microns. The results are set forth in Table II below:

TABLE II

| % by weight smaller than 2 microns | % by weight greater than 10 microns |
|---|---|
| Planetary mill | |
| 50 | 20 |
| 60 | 7.5 |
| 70 | 2.4 |
| 75 | 1.1 |
| 80 | 0.46 |
| 85 | 0.14 |
| 90 | 0.04 |
| Stirred sand mill | |
| 50 | 10 |
| 60 | 4.9 |
| 70 | 2.4 |
| 75 | 1.7 |
| 80 | 1.2 |
| 85 | 0.8 |
| 90 | 0.58 |

These results show that the planetary mill gives a product which has a smaller proportion of particles having an equivalent spherical diameter larger than 10 microns for a given percentage by weight of particles smaller than 2 microns. Since the fraction consisting of particles larger than 10 microns generally contains the bulk of any abrasive impurity particles which may be present, the product of the planetary mill is of greater quality than the product of the stirred sand mill for a given percentage by weight of particles smaller than 2 microns.

EXAMPLE 4

Each grinding chamber of a planetary mill of the type described above was charged with 400 g of marble chips of size−4 mm+1 mm and 100 g of water in which was dissolved 0.2 g of a sodium polyacrylate dispersing agent. Since the specific gravity of the marble is 2.71, the volume occupied by the marble was 147.6 ml and the total volume of the charge 247.6 ml. The volume of each grinding chamber was 500 ml and the percentage of the volume occupied by the charge was therefore 49.5%. The mill was rotated at a gyratory speed of 120 rpm, the sizes of the sprockets taking the chain drive to the grinding chambers being such that the grinding chambers revolved about their own axes at twice the gyratory speed but in the opposite direction. After grinding had continued for 30 minutes the contents of the grinding chamber were screened on a No. 300 mesh British Standard sieve (nominal aperture 53 microns) and the percentage by weight of marble which passed through the sieve was determined. The percentages by weight of particles having an equivalent spherical diameter larger than 10 microns and smaller than 2 microns, respectively, were also determined for the suspension which passed through the sieve.

The experiment was then repeated for gyratory speed of 180 rpm, 243 rpm and 278 rpm and the results are set forth in Table III below:

TABLE III

| | % by weight | Percentage by weight in the −53 microns fraction | |
|---|---|---|---|
| Gyratory speed r.p.m. | smaller than 53 microns | larger than 10 microns | smaller than 2 microns |
| 120 | 7.1 | 6.1 | 62.5 |
| 180 | 17.6 | 0.5 | 83.2 |
| 243 | 32.8 | 0.3 | 80.2 |
| 278 | 38.6 | 0.3 | 75.4 |

These results show that it is possible by autogenous planetary milling to produce a paper coating quality ground marble from marble chips in a single operation.

EXAMPLE 5

Each grinding chamber of a planetary mill of the type described above was charged with 400g of marble chips of size−12 mm+2 mm and 100 g of water in which was dissolved 0.2 g of a sodium polyacrylate dispersing agent. The mill was rotated at a gyratory speed of 278 rpm, the grinding chambers revolving about their own axes in the opposite direction at 556 rpm. Grinding was continued for a time of 5 minutes, and at the end of this time the contents of the grinding chamber were tested for percentage by weight of dry particles passing a No. 300 mesh BS sieve and the percentage by weight in the fraction passing through the sieve of particles having an equivalent spherical diameter larger than 10 microns and smaller than 2 microns respectively. The experiment was then repeated for grinding times of 10, 15, 20, 30 and 60 minutes respectively.

As a comparison, a further sample of the same marble chips was mixed with water and the same dispersing agent in the same proportions and ground for 60 minutes in a stirred mill. The product was tested in the same way as described above.

The results are set forth in Table IV below:

TABLE IV

| | Grinding | % by weight | % by wt. in the −53 micron fraction | |
|---|---|---|---|---|
| Mill | time (Minutes) | smaller than 53 microns | larger than 10 microns | smaller than 2 microns |
| Planetary | 5 | 23.5 | 27.4 | 27.0 |
| " | 10 | 33.4 | 17.0 | 33.9 |
| " | 20 | 42.9 | 8.4 | 40.3 |
| " | 30 | 49.8 | 6.1 | 43.8 |
| " | 60 | 58.1 | 2.7 | 50.1 |

TABLE IV-continued

| | Grinding | % by weight | % by wt. in the −53 micron fraction | |
|---|---|---|---|---|
| Mill | time (Minutes) | smaller than 53 microns | larger than 10 microns | smaller than 2 microns |
| Stirred | 60 | 25 | 44 | 24 |

It can be seen that the planetary mill ground the marble chips to a fine powder much more rapidly than the stirred mill.

EXAMPLE 6

A coarse kaolinitic clay having a particle size distribution such that 20% by weight consisted of particles having an equivalent spherical diameter larger than 10 microns and 13.4% by weight consisted of particles having an equivalent spherical diameter smaller than 2 microns was mixed with sufficient water to form a suspension containing 50% by weight of dry clay. There was dissolved in the water 0.3% by weight, based on the weight of dry clay, of a sodium polyacrylate dispersing agent. 115 ml of this suspension was charged into each of the grinding chambers of a planetary mill of the type described above, together with 135 ml (359 g) of Ottawa sand of size−1.0 mm+0.5 mm. The charge occupied 50% of the volume of each grinding chamber and the grinding sand accounted for 54% of the volume of the charge. The mill was rotated at a gyratory speed of 278 rpm, the grinding vessels rotating about their own axes in the opposite direction at 556 rpm. Grinding was continued for 5 minutes and the suspension of ground clay was tested for percentage by weight of the particles having an equivalent spherical diameter larger than 10 microns and small than 2 microns respectively. The experiment was then repeated for grinding times of 10, 15, 20, 30 and 60 minutes respectively.

The results are set forth in Table V below:

TABLE V

| Grinding | % by weight of the product | |
|---|---|---|
| time (minutes) | larger than 10 microns | smaller than 2 microns |
| 0 | 20 | 13.4 |
| 5 | 1.4 | 36.7 |
| 10 | 1.0 | 50.1 |
| 15 | 0.92 | 58.5 |
| 20 | 1.5 | 65.2 |
| 30 | 0.9 | 70.2 |
| 60 | 0.4 | 83.0 |

In 60 minutes the coarse kaolinitic clay was ground to the particle size distribution of a paper quality clay.

EXAMPLE 7

A sample of muscovite mica which had been previously comminuted and classified so that substantially all of it is sufficiently fine to pass through a No. 200 mesh British Standard sieve (nominal aperture 76 microns) was mixed with sufficient water to form a suspension containing 50% by weight of dry mica, there being dissolved in the water 0.3% by weight, based on the weight of dry mica, of a sodium polyacrylate dispersing agent. 115 ml of this suspension was charged into each grinding chamber of the planetary mill together with 135 ml (459 g) of −1.0 mm +0.83 alumina granules. The charge occupied 50% of the volume of each grinding chamber and the grinding medium accounted for 54% of the volume of the charge. The mill was rotated at a gyratory speed of 278 rpm, the grinding chambers revolving about their own axes in the opposite direction at a speed of 556 rpm. Grinding was continued for 5 minutes and the suspension was then tested for percentage by weight of particles having an equivalent spherical diameter larger than 10 microns and smaller than 2 microns, respectively. The experiment was then repeated for grinding times of 10, 15, 20, 30 and 60 minutes respectively. The results are set forth in Table VI below:

TABLE VI

| Grinding time (minutes) | % by weight of the product: larger than 10 microns | % by weight of the product: smaller than 2 microns |
|---|---|---|
| 0 | 42.2 | 6.5 |
| 5 | 19.4 | 24.3 |
| 10 | 15.8 | 25.2 |
| 15 | 14.2 | 32.1 |
| 20. | 13.3 | 35.3 |
| 30 | 8.1 | 44.1 |
| 60 | 3.4 | 72.7 |

Mica is difficult to grind efficiently by conventional methods but by the process of the invention a high degree of fineness is achieved in 60 minutes.

By way of example, a planetary mill in accordance with another aspect of the present invention, suitable for carrying out the processes described in the Examples, is illustrated in the accompanying drawings, in which:

FIG. 3 is an enlarged view of another type of grinding chamber;

FIGS. 6 and 7 are sectional side elevations of two further types of feeding device for a planetary mill for autogenous grinding.

FIG. 8A is an enlarged section through a cylindrical screen cage as shown in FIG. 2; and FIG. 8B is a section on line AA in FIG. 8A.

Figure 1:
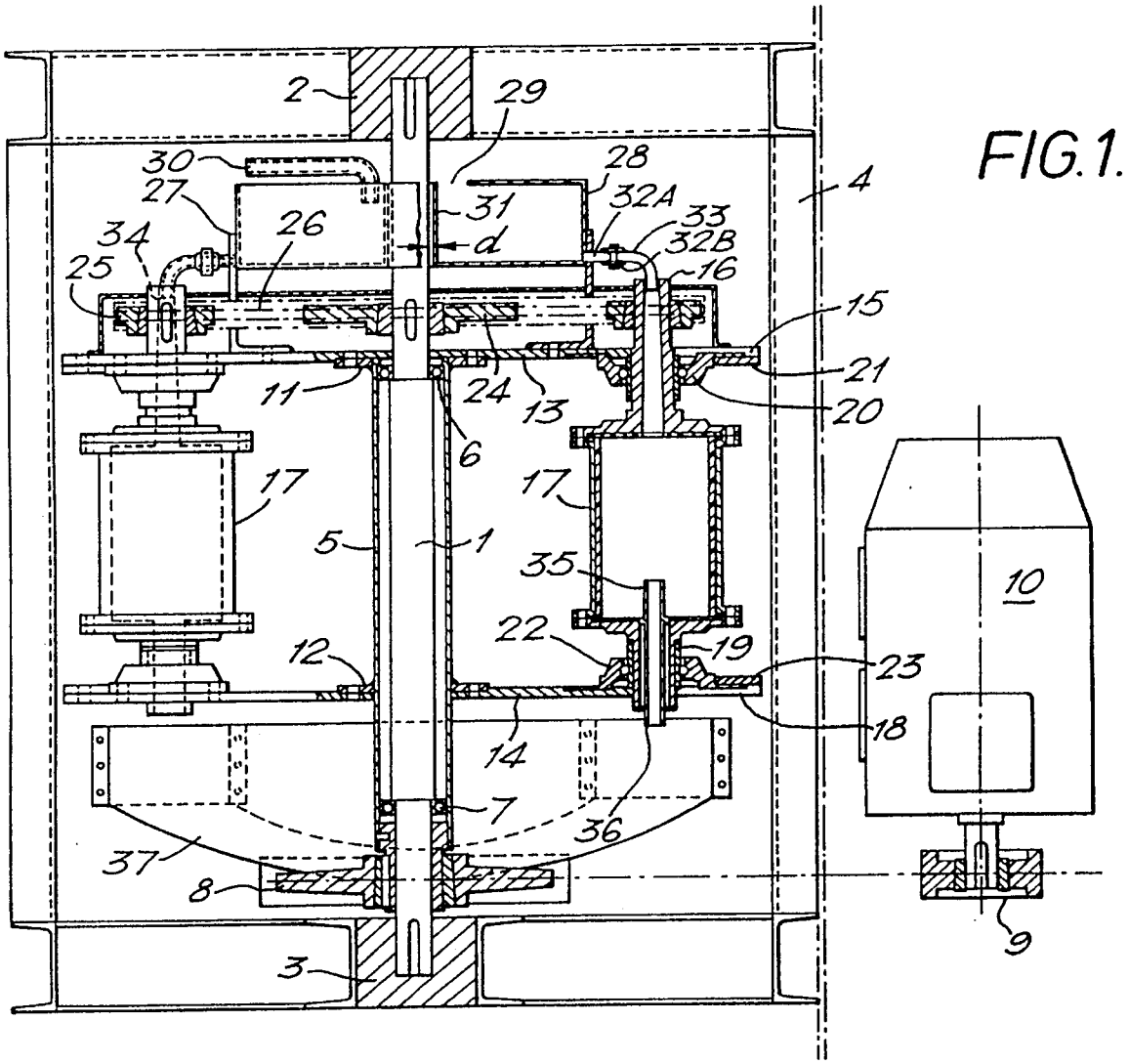
FIG. 1 shows a general arrangement of a planetary mill for wet fine media grinding.

Referring first to FIG. 1, a central stationary shaft 1 is keyed at its upper end into a block 2 and at its lower end into a block 3, both blocks forming part of a supporting framework 4. A hollow shaft 5 is supported coaxially with the central shaft 1 by means of an upper ball bearing race 6 and a lower ball bearing race 7. A pulley 8 is keyed on to the lower end of the hollow shaft 5 and is interconnected for drive with a pulley 9 keyed on to the shaft of an electric motor 10 by means of a belt (not shown). To the hollow shaft 5 are welded an upper flange 11 and a lower flange 12. To these flanges are bolted, respectively, an upper plate 13 and a lower plate 14, each of approximately rectangular shape. Each outer end of the upper plate is provided with a longitudinally extending slot 15 which receives the upper neck 16 of one of two grinding chambers 17, and each outer end of the lower plate 14 is provided with a similar slot 18 which receives the lower neck 19 of a grinding chamber. The upper neck 16 of each grinding chamber is rotatably supported in a ball bearing race 20 which is clamped in place by a bar 21 bolted to the upper plate 13. Similarly the lower neck 19 of each grinding chamber is rotatably supported in a ball bearing race 22 which is clamped in place by a bar 23 bolted to the lower plate 14. The grinding chambers 17 are provided with sprockets 25, which sprockets 25 are connected, by means of a chain 26, to a sprocket 24 which is keyed to the stationary shaft.

To the upper plate 13 are bolted supporting brackets 27 for a substantially lozenge-shaped tank 28. In the top of tank 28 is a central circular opening 29 thorough which passes the outlet end of a feed conduit 30, through which is supplied a suspension of solid particles to be ground. The tank 28 also has a central sleeve 31, extending the full height of the tank, which surrounds the stationary shaft 1 at a spacing "d". The tank is provided with two outlets 32A for feed suspension, each of which is coupled by means of a releasable coupling 32B to a 90° pipe bend 33, the open end of which is a sliding fit in the upper end of a tapered bore 34 provided in the upper neck 16 of each grinding chamber 17.

Figure 2:
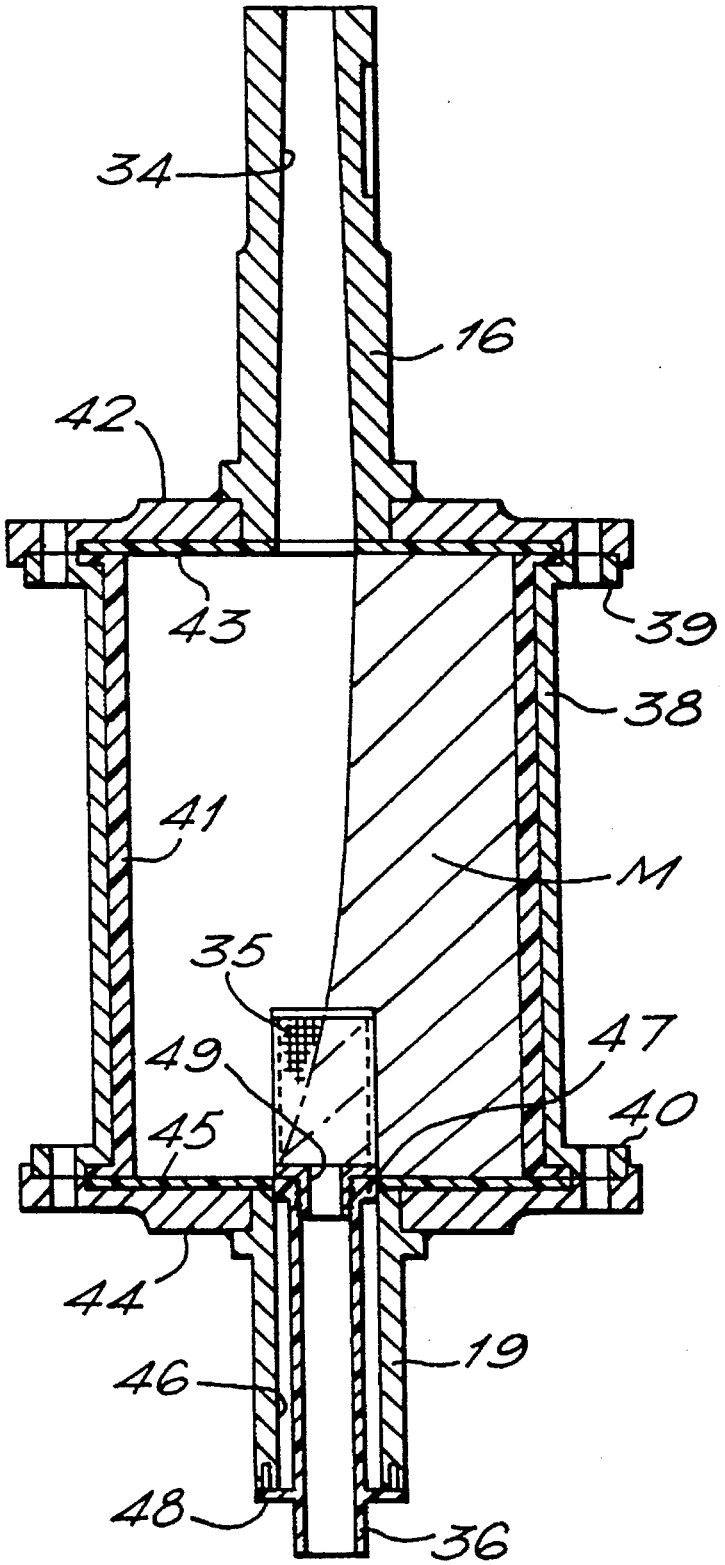
FIG. 2 is an enlarged view of a grinding chamber of the planetary mill.

FIG. 2 shows a grinding chamber in greater detail. The grinding chamber comprises a cylindrical portion 38 having a top flange 39 and a bottom flange 40. The cylindrical portion is provided with an abrasion-resistant lining 41 of polyurethane. A top plate 42, into which is fixed the upper neck 16, is bolted to the top flange 39, and a disc 43 of polyurethane, having a central hole, is accommodated in a circular recess in the top plate 42 to provide an abrasion-resistant lining. Similar, a bottom plate 44, into which is fixed the lower neck 19, is bolted to the bottom flange 40, and a disc 45 of polyurethane, having a central hole, is accommodated in a circular recess in the bottom plate. The outlet 36 is accommodated in a cylindrical bore 46 in the lower neck 19 and is provided with an upper flange 47 and a lower flange 48. The lower flange 48 is bolted to the end of the lower neck 19 and the upper flange 47 makes a water-tight seal with the lower neck 19 and is threaded internally to receive the threaded neck portion 49 of a cylindrical screen cage 35 (see FIGS. 8A and 8B), which is closed at its upper end and is formed by winding a helix of stainless steel wedge-section wire 35A on a cage of longitudinal stainless steel rods 35B the wires 35A being welded to the rods 35B where they intersect. The spacing between the turns of the helix may be, for example, 0.3 mm.

In operation, the electric motor 10 rotates the pulley 8 by means of the belt driven by pulley 9, so that the upper plate 13 and lower plate 14 are rotated about the central stationary shaft 1. Rotation of the plates 13, 14 causes rotation of the chain 26 about the pullies 25 fixed to the upper neck 16 of each grinding chamber 17. By means of this arrangement the grinding chambers 17 are caused to rotate about their longitudinal axis in a direction which is opposite to the sense of rotation of the hollow shaft 5. The sizes of the sprockets 24 and 25 are chosen so that the speed of rotation of the grinding chambers is twice the speed of rotation of the hollow shaft 5.

A suitable quantity of a particulate grinding medium having a particle size range of 0.5 mm to 1.0 mm is charged to each grinding chamber before grinding is commenced. Feed suspension enters each grinding chamber through the bore 34, via the tank 28. Regulation of the feed rate is achieved by controlling the rate of supply of feed suspension into the tank 28. The material in the grinding chamber is subject to centrifugal forces generated by the rotation of the grinding chamber about its own axis, to a centrifugal force generated by the rotation of the upper plate 13 and the lower plate 14 about their central axis and to a Coriolis force. If the drive ratio is such that the speed of rotation of each grinding chamber about its own axis is twice the speed of rotation of the upper and lower plates, the Coriolis force will be equal and opposite to the centrifugal force generated by the rotation of each grinding chamber about its own axis. The result of this complex system of forces is that the material M in each grinding chamber "piles up" against the part of the wall of the grinding chamber which at any instant is furthest from the centre of rotation of the upper and lower plates, as shown in FIG. 2. As each grinding chamber is itself rotating, a "rolling" motion is imparted which provides the agitation necessary to grind the particles in the feed suspension.

AS grinding proceeds, fresh feed suspension containing relatively coarse particles is continuously introduced at the top of the grinding chamber, and suspension containing particles smaller than 0.3 mm is continuously withdrawn through the screen 35 at the bottom. The suspension passes vertically downwards through the grinding chamber in "plug flow"; in other words there is little mixing in the vertical direction. As the suspension progresses downwards through the grinding chamber,.the particles it contains are ground finer and finer. Thus, with respect to the feed particles, but not to the particles of the grinding medium, if used, there is a size gradient from the top to the bottom of the grinding chamber, with the finest particles at the bottom. The finest particles are able to pass through the screen cage 35 mounted in the bottom of each grinding chamber and are discharged through the outlet 36 into an annular trough 37 situated below the grinding chambers 17 (see FIG. 1).

FIG. 3 shows a grinding chamber which is identical to that shown in FIG. 2 except that the screen cage 35, which may take the form of a cage of longitudinal stainless steel wedge-section wires supported on a stainless steel wire helix, the wires being welded together where they intersect, is accommodated within the bore 46 of the lower neck 19. A suspension of finely ground particles passes between the wires of the screen cage 35 into an annular space 50, between the outlet 36 and the inner wall of the lower neck 19, and thence through apertures 51 into the lower part of the outlet 36. A blanking plate 52 seals the bottom of the screen cage 35 from the lower part of the outlet 36.

Figure 4:
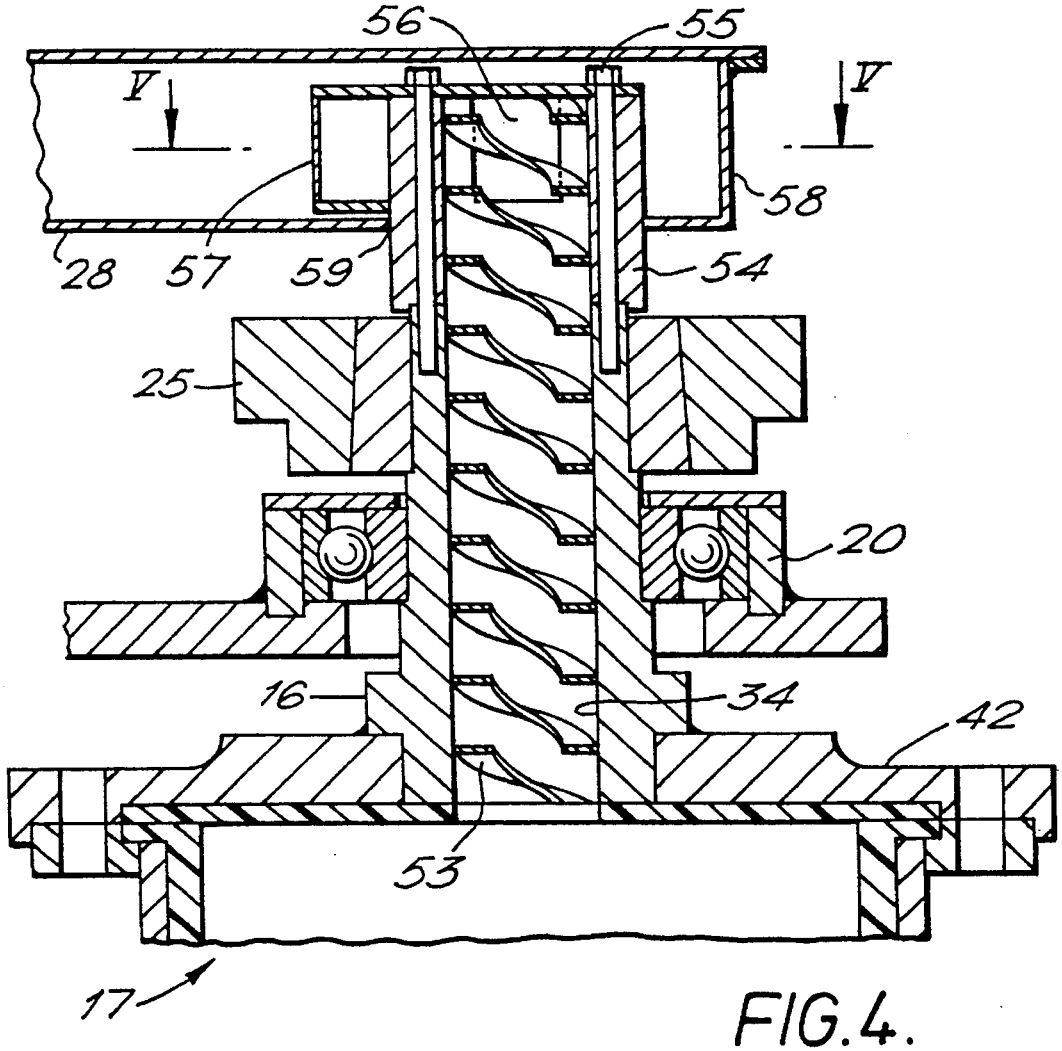
FIG. 4 is a sectional side elevation of a feeding device for a planetary mill for autogenous grinding.
Figure 5:
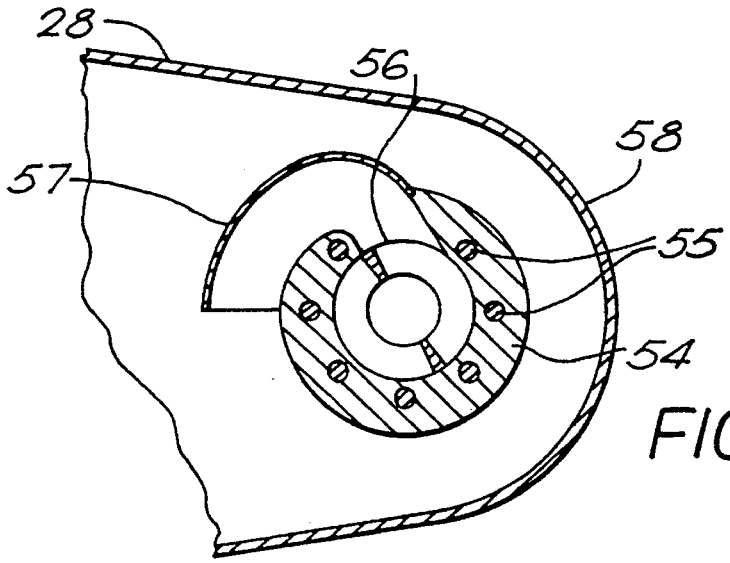
FIG. 5 is a section on line V—V in FIG. 4.

FIGS. 4 and 5 show in detail an arrangement for feeding to a grinding chamber a suspension of relatively coarse particulate material as a feed suspension for a fine wet autogenous grinding process. Into the top plate 42 of a grinding chamber 17 there is fixed an upper neck 16 which has a straight cylindrical bore 34 into which is fixed a double helix 53 which projects beyond the upper end of the neck 16. Covering the projecting portion of the double helix 53 is a cap 54 which is secured to the upper part of the neck 16 by bolts 55 and which has a side aperture 56 at its upper end which communicates with a convolute scoop portion 57. As described above, the upper neck 16 of the grinding chamber is rotatably supported in a ball bearing race 20 and the grinding chamber is rotated in an anti-clockwise sense by a chain (not shown) passing around a sprocket 25 which is keyed to the upper neck. The upper part of the cap 54 rotates within an extended end portion 58 of the tank 28, and suspension containing relatively coarse particulate material is forced into the mouth of the scoop portion 57 and caused to travel in a helical path down the upper neck 16 into the top of the grinding chamber 17. A liquid-tight rotating seal is provided at 59 where the cap passes through the bottom of the tank 28.

Figure 6:
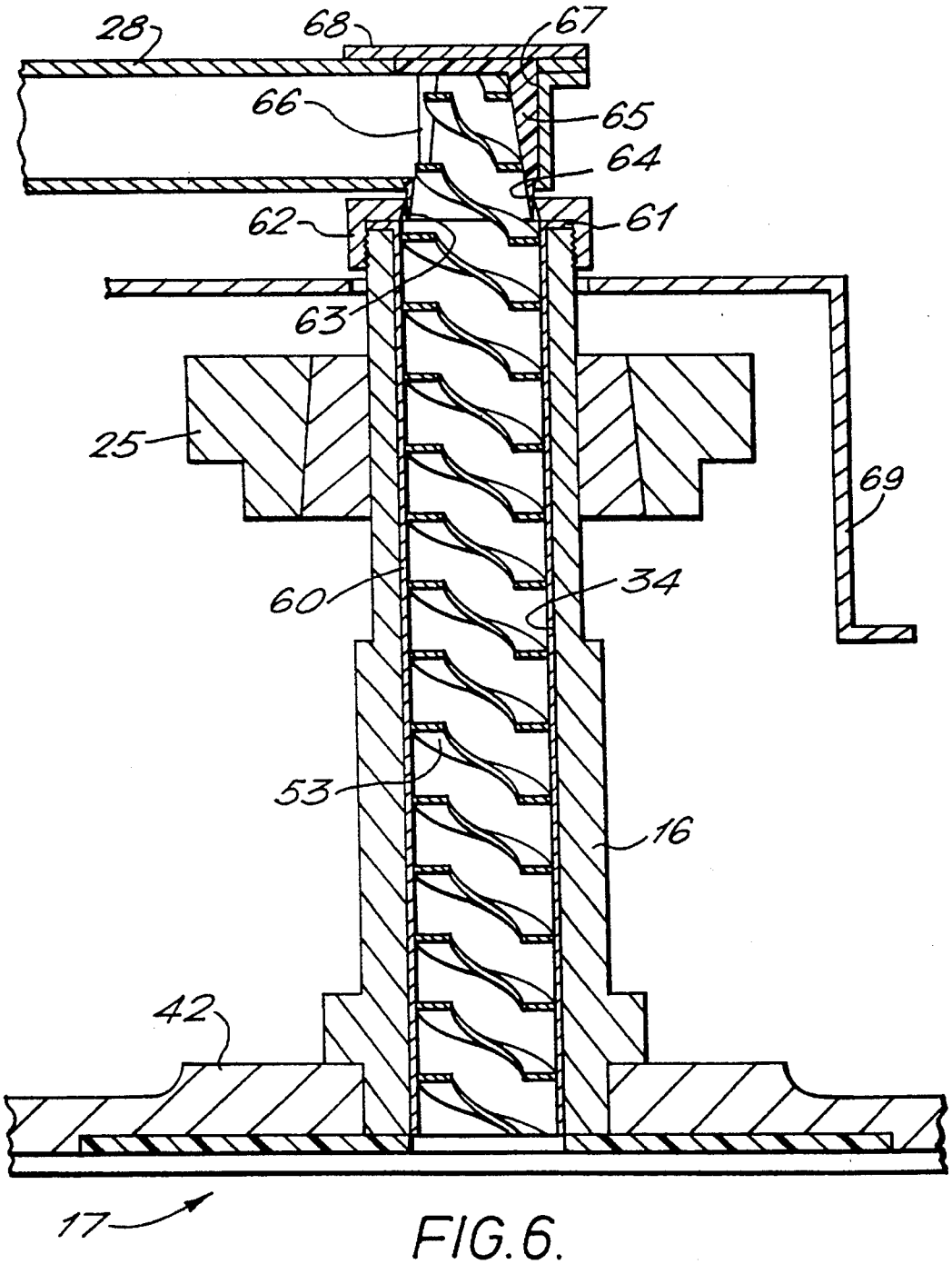

FIG. 6 shows in detail a modified arrangement for feeding to a grinding chamber a suspension of relatively coarse particulate material as a feed suspension for a fine wet autogenous grinding process. Into the top plate 42 of a grinding chamber 17 is fixed an upper neck 16 having a straight cylindrical bore 34 into which is inserted a cylindrical sleeve 60 having an upper flange portion 61. Within the cylindrical sleeve 60 is fixed a double helix 53 which projects beyond the upper end of the neck 16. A cap 62 is screwed on to the upper end of the neck 16, trapping the flange portion 61 between the cap and the upper end of the neck. The double helix 53 projects through an aperture 63 in the cap 62 and through an aperture 64 in the tank 28, and a polyurethane cup 65 with a large aperture 66 in one side forms an abrasion-resistant lining for the outer end of the tank and seals with the bottom of the tank and with the cap 62. The polyurethane cup 65 is located in a aperture 67 in the top tank and is held in place by means of a removable lid 68. A safety guard 69 is provided around the sprocket 25 and drive chain. In this embodiment no rotating scoop is necessary because the suspension of coarse particulate material is forced into the upper part of the double helix by the centrifugal action of the suspension within the rotating tank 28.

FIG. 7 shows a feeding arrangement which is identical to that shown in FIG. 6 except that a single helix 70 formed around a central shaft 71 is used instead of the double helix. The cylindrical sleeve 60 extends only a relatively short distance into the bore 34 to promote easier withdrawal of the sleeve and of the helix.

Use of feeding arrangements of the type shown in FIGS. 4 to 8 also enables a planetary mill for wet fine autogenous grinding to be disposed so as to rotate about a horizontal axis, instead of a vertical axis as shown in FIG. 1.

I claim:

1. A continuous process for wet grinding a feed material in a planetary mill, said mill comprising a support which rotates about a primary axis and which carries a grinding chamber which rotates about a secondary axis, relatively to the support, in the direction of rotation of the support, said material being introduced into the mill in suspension in a liquid and being comminuted in the mill in the presence of a grinding medium consisting of particles not smaller than 0.5 mm and not larger than 1 mm.

2. A continuous process for wet grinding a particulate solid feed material having a maximum particle size of 12 mm in a planetary mill, said mill comprising a support which rotates about a primary axis and which carries a grinding chamber which rotates about a secondary axis, relatively to the support, in the direction of rotation of the support, said material being introduced into the mill in suspension in a liquid and being comminuted autogenously in the mill.

3. A process as claimed in claim 1, in which the liquid in water.

4. A process as claimed in claim 1, in which the comminuted product comprises at least 40% by weight of particles having an equivalent spherical diameter smaller than 2 microns.

5. A process as claimed in claim 1, in which the maximum centrifugal acceleration of the particles in the planetary mill is not less than 3 times the acceleration due to gravity.

6. A process as claimed in claim 5, in which the maximum centrifugal acceleration of the particles in the planetary mill is not less than 5 times the acceleration due to gravity.

7. A process as claimed in claim 1, in which the grinding chamber rotates about the secondary axis at a speed greater than the speed of rotation of the support about the primary axis.

8. A process as claimed in claim 2, in which the liquid is water.

9. A process as claimed in claim 2, in which the comminuted product comprises at least 40% by weight of particles having an equivalent spherical diameter small than 2 microns.

10. A process as claimed in claim 2, in which the grinding chamber rotates about the secondary axis at a speed greater than the speed of rotation of the support about the primary axis.

* * * * *